US005325611A

United States Patent [19]

Dyer et al.

[11] Patent Number: 5,325,611

[45] Date of Patent: Jul. 5, 1994

[54] COMFORT CRADLE SYSTEM FOR FOOTWEAR CONSTRUCTION

[75] Inventors: Robert M. Dyer, St. Louis County, Mo.; Zenon O. Smotryez; Edward J. Norton, both of Middlesex County, Mass.

[73] Assignee: Brown Group, Inc.

[21] Appl. No.: 101,680

[22] Filed: Aug. 3, 1993

Related U.S. Application Data

[63] Continuation of Ser. No. 962,913, Oct. 19, 1992, abandoned.

[51] Int. Cl.[5] ..... A43B 13/12; A43B 13/28

[52] U.S. Cl. ..... 36/30 R; 36/27; 36/28; 36/37

[58] Field of Search ..... 36/114, 30 R, 30 A, 36/32 R, 37, 38, 107, 108, 28, 27

[56] References Cited

U.S. PATENT DOCUMENTS

| | | | |
|---|---|---|---|
| 4,551,930 | 11/1985 | Graham et al. | 36/30 |
| 4,598,486 | 7/1986 | Olivieri | 36/30 R X |
| 4,656,760 | 4/1987 | Tonkel et al. | 36/28 |
| 4,709,489 | 12/1987 | Welter | 36/38 X |
| 4,741,114 | 5/1988 | Stubblefield | 36/32 |
| 4,759,136 | 7/1988 | Stewart et al. | 36/114 |
| 4,768,295 | 9/1988 | Ito | 36/28 |
| 4,776,679 | 8/1988 | Bender | 36/30 R |
| 4,815,221 | 3/1989 | Diaz | 36/28 X |
| 4,845,863 | 7/1989 | Yung-Mao | 36/114 |
| 4,878,300 | 11/1989 | Bogaty | 36/35 R |
| 4,878,301 | 11/1989 | Kiyosawa | 36/35 R X |
| 4,879,821 | 11/1989 | Graham et al. | 36/37 X |
| 4,922,631 | 5/1990 | Anderle | 36/114 X |
| 4,934,072 | 6/1990 | Fredericksen et al. | 36/29 |
| 5,005,299 | 4/1991 | Whatley | 36/28 X |
| 5,046,267 | 9/1991 | Kilgore et al. | 36/30 R X |
| 5,052,130 | 10/1991 | Barry et al. | 36/30 R X |
| 5,070,629 | 12/1991 | Graham et al. | 36/28 X |
| 5,077,916 | 1/1992 | Beneteau | 36/114 |
| 5,280,680 | 1/1994 | Burke et al. | 36/28 |

FOREIGN PATENT DOCUMENTS

| | | | |
|---|---|---|---|
| 9001276 | 2/1990 | World Int. Prop. O. | 36/30 R |

OTHER PUBLICATIONS

*Newsweek*, "Tenite Polyethylene an Eastman Plastic", Feb. 24, 1958, p. 101.

*Primary Examiner*—Paul T. Sewell
*Assistant Examiner*—Beth Anne C. Cicconi
*Attorney, Agent, or Firm*—Polster, Lieder, Woodruff & Lucchesi

[57] ABSTRACT

Footwear construction having a comfort cradle device disposed in a midsole socket for support above the outsole contact with a walking or running surface and in which the cradle device is shaped to afford self centering and position stability for the wearer's foot. The cradle device is interlocked with the midsole through a system of fingers that move in response to the shift in applied load to return energy to the cradle.

8 Claims, 2 Drawing Sheets

COMFORT CRADLE SYSTEM FOR FOOTWEAR CONSTRUCTION

This is a continuation of copending application Ser. No. 07/962,913 filed on Oct. 19, 1992, now abandoned.

BACKGROUND OF THE INVENTION

1. Field of the Invention

This invention is directed to improvements in a comfort cradle system for footwear construction.

2. Description of the Prior Art

The art of footwear construction in the period from 1985 to the present time has included:

Graham et al U.S. Pat. No. 4,551,930 of Nov. 12, 1985 sole construction for footwear which included an integral midsole/wedge or a wedge for use as a midsole in which combined a shell and an encapsulated core resulting in shock dispersion and a memory system depending on the characteristics of material used.

Tonkel et el U.S. Pat. No. 4,656,760 of Apr. 14, 1987 for cushioning and impact absorptive means for footwear having the characteristics of encapsulation of a cellular insert of woven material having voids or cavities in wound strands of a polymer having a hardness exceeding that of the foamed or other polymer composition for cushioning forces of impact exerted upon a shoe sole.

Stubblefield U.S. Pat. No. 4,741,114 of May 3, 1988 for shoe sole construction including an outer sole of uniform thickness and a midsole having peripheral portions that are relatively thick compared to the central portion which is relatively thin.

Stewart et al U.S. Pat. No. 4,759,136 of Jul. 26, 1988 for an athletic shoe with dynamic cradle of a lightweight midsole of compressible material with portions of differing hardness which limit over-pronation and effectively absorb shock while conforming to a foot shape.

Yung-Mao U.S. Pat. No. 4,845,863 of Jul. 11, 1989 for shoe having a transparent window for viewing cushion elements in which a preselected cushionability selected according to the wearer's weight or cushion preference is insertable.

Barry et al U.S. Pat. No. 5,052,130 of Oct. 1, 1991 for a spring plate shoe in which the spring plate is combined with a viscoelastic midsole and has multiple layers of carbon fibers embedded in polymer, with the fibers being at acute angles in successive layers, in symmetry.

SUMMARY OF THE INVENTION

An object of the invention is to produce a cradle construction for shoe heel applications which is characterized by a moldable plastic material having foamed cushioning means combined therewith.

It is also an object to provide a shoe heel construction adapted to accommodate a cradle device which combines a thermal plastic material with a foamed cushion material such as a urethane core composed of either silicon-polyurethane or a high rebound polyurethane material.

Another object is to combine in a molded cradle the formation of a system of separate opposed fingers positioned below the heel of the foot so that as the wearer's body weight is applied to the rear of the foot the proper fingers will respond with a desired give or resistance commensurate with the applied weight, and as the foot moves forward through the gait cycle the weight applied to the fingers will snap back to provide or return boost to the foot.

Still another object is to provide a device capable of shock absorption and return of energy to the foot, as well as a self centering device which is obtained by an opening beneath the device so the rear of a foot is actually suspended over an opening supported by the fingers of the device.

The movement up or down of the cradle's "fingers" is found directly below the rear foot. When body weight is applied to the rear of the foot each finger will respond with just the right amount of "give" or resistance required for the weight load. As the foot moves forward through the walking or running gait cycle, the weight is successfully applied to the next "finger" while the previous finger snaps back into position providing a return or extra boost to the foot.

Still another object is found in the method of shaping the midsole to the shape of a system of cradle fingers thereby forming a suspension in the outsole for the rear of the foot so the midsole and outsole respond in concert with the cradle to gain additional cushioning and stability.

A further object resides in the method of constructing a shoe heel cradle system by molding the cradle with a foamed cushion, and suspending that combination in a mold and then applying that suspension to form a desired midsole after which the outsole components may be applied to the midsole.

The foregoing objects and others set forth in the following description achieve essential benefits in the mechanical cushioning and shock absorption, in the stability to the foot from the formation of a system of fingers, and in the self centering suspension of the foot.

BRIEF DESCRIPTION OF THE DRAWINGS

The drawings provide a better understanding of the construction of the footwear.

DETAIL DESCRIPTION OF THE CONSTRUCTION

Figure 1:
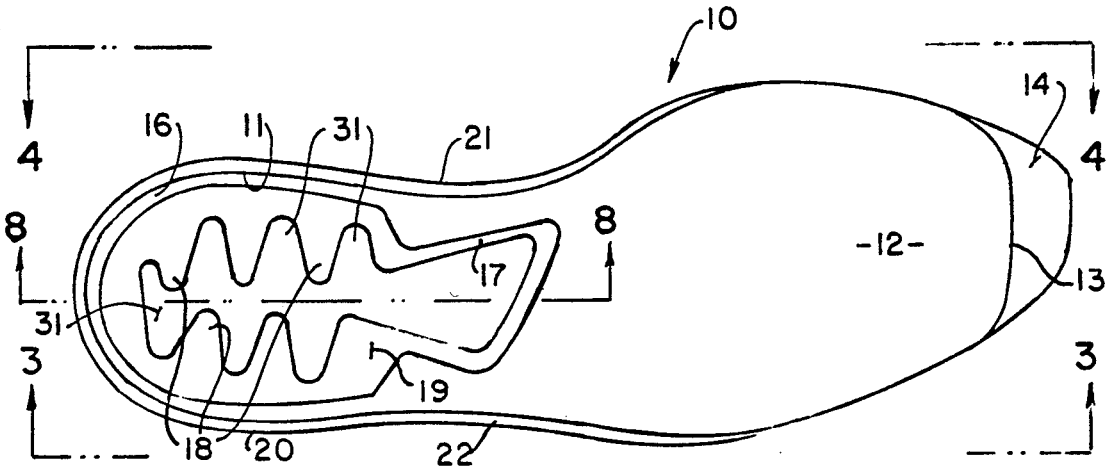
FIG. 1 is a plan view of the midsole looking from the top to reveal the mounting space for a cushion device.

FIG. 1 is a plan view looking down on the midsole 10 to show the form of an opening defined by a socket 11 in the heel, and the opening extending into instep areas thereof. The forepart area 12 ends at a toe margin 13 which exposes the toe end surface 14 of a tread ply 15 to be referred to presently. The socket 11 in the heel area is formed with a circumferential ledge 16 that extends around the margin of the socket and into the instep area 17. That ledge 16 includes a plurality of finger projections 18 that are arranged around the margin of the ledge 16. That ledge 16 extends into the instep area and provides additional surfaces 19. The midsole 10 is formed with upwardly projecting side surfaces defining the heel wall 20 for the midsole, and that surface extends along the side 21 and side 22 and tapers into the margins of the forepart 12.

Figure 2:
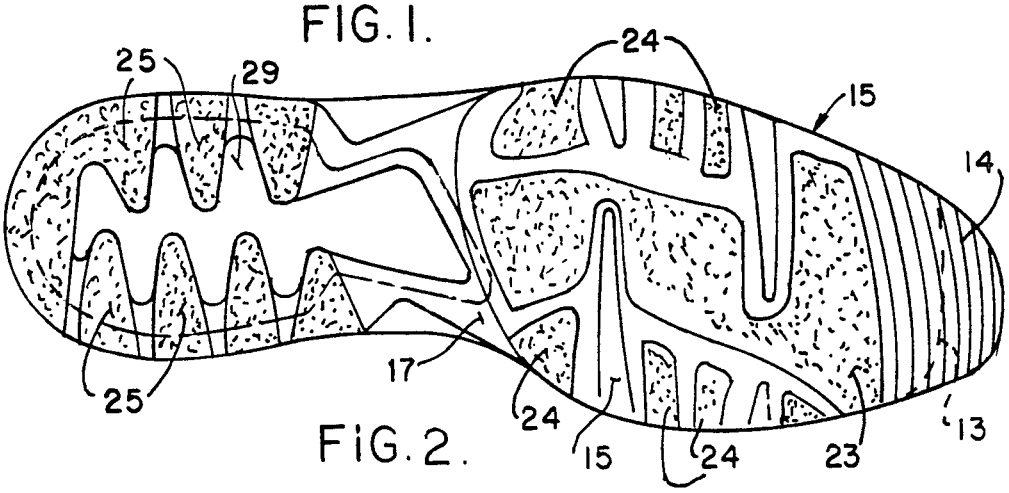
FIG. 2 is a plan view from the bottom of the midsole to show the outsole surfaces mounted thereon.
Figure 3:
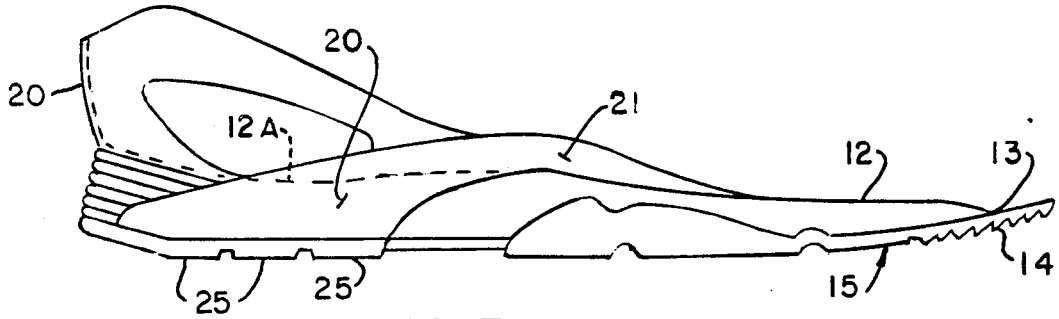
FIG. 3 is a longitudinal elevation from the instep side of the midsole as seen along line 3—3 in FIG. 1.

FIG. 2, is a plan view of the bottom of the midsole 10, the view showing the outsole surface thereof being covered in the forepart 12 by the outsole tread ply 15 having the toe ply 14 extending beyond the rounded end 13 of the midsole 10. That outsole 15 is formed with a pattern of wear pads which may include a principal pad 23, and a plurality of other pads collectively seen at 24. The outsole 15 which is adhesively secured to the midsole, as seen in FIG. 3, not only provides the bottom surface of the midsole 10 but is formed also with outsole wear pads 25 which are finger elements matching the fingers 18 in the heel area of the midsole 10. Thus, the midsole 10 and outsole 15 together constitute a body for supporting the forepart and heel parts of a wearer's foot.

Figure 4:
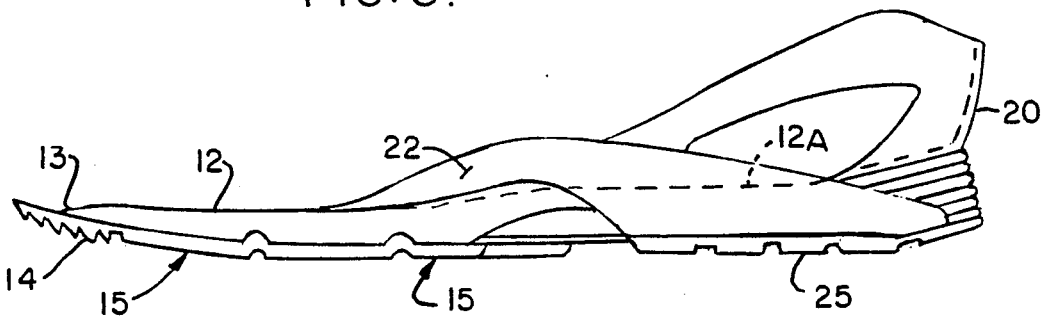
FIG. 4 is a longitudinal elevation from the opposite side of the midsole as seen along line 4—4 in FIG. 1.

FIG. 3 is a side elevation of the midsole 10 to show the thickness thereof as the surface extends along the dotted line 12A to the vertical heel wall 20. That surface 12 and 12A is enclosed by the tapering side walls 21 and 22. In a similar manner, the opposite margin of the midsole 10 is seen in FIG. 4 to show the tapering side wall 22 and the thickness of the midsole 10 in the heel area depicted by the dotted line 12A. Moreover, the forepart 15 of the outsole is indicated, as are the outsole pads 25 in the heel.

Figure 7:
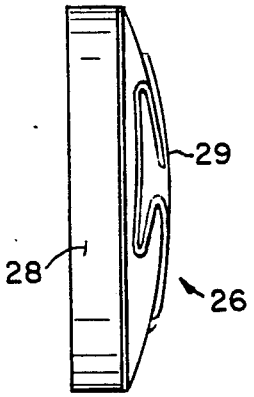
FIG. 7 is an end elevation seen along line 7—7 in FIG. 5.
Figure 5:
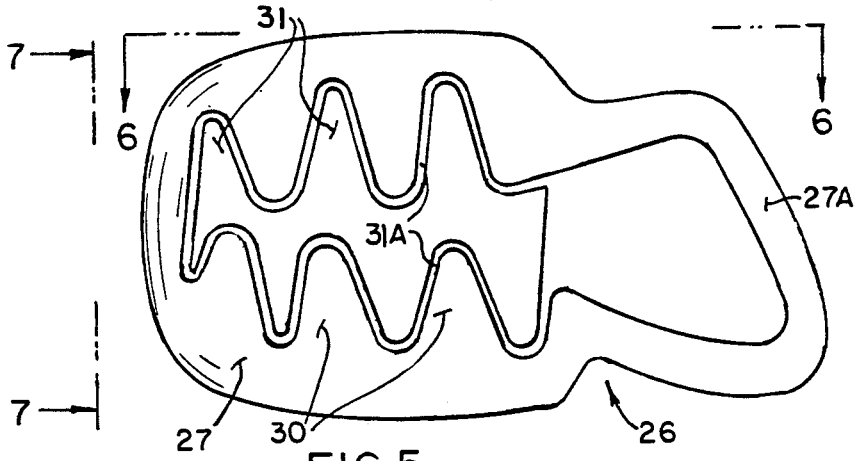
FIG. 5 is a plan view of a cradle element to fit into the socket seen in FIG. 1 before a cushion is attached.
Figure 6:
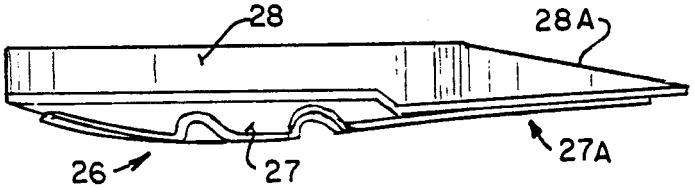
FIG. 6 is a side view of the cradle element fitted with a cushion as seen along 6—6 in FIG. 5.
Figure 8:
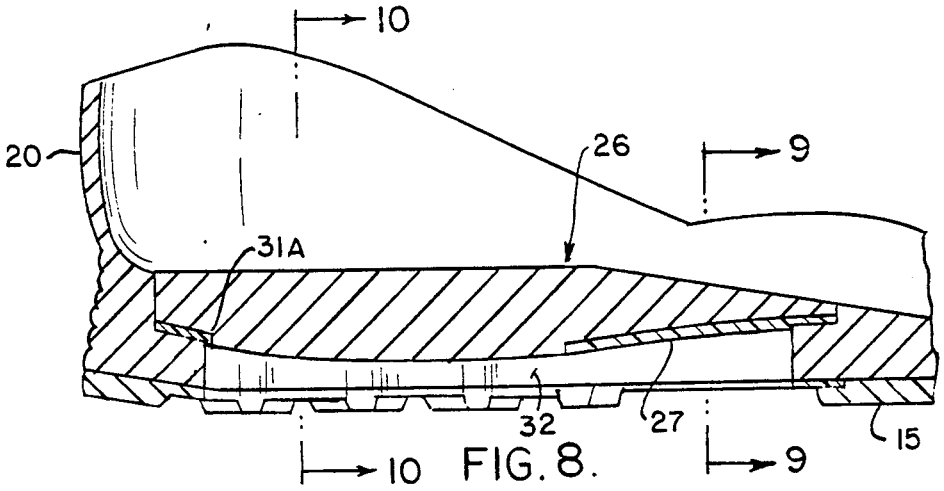
FIG. 8 is a fragmentary sectional view of the socket for the reception of a cushion centering device seen along line 8—8 in FIG. 1.
Figure 9:
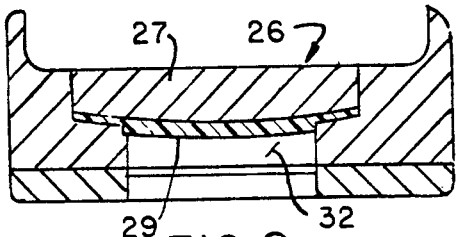
FIG. 9 is a transverse sectional view of the cushion centering device installed and taken along line 9—9 in FIG. 8.

The midsole 10 of FIG. 1, as noted before, is formed with a socket 11 in the heel and instep areas for the reception of a cushioned cradle device 26 seen in FIGS. 5, 6 and 7. That device comprises a cradle ply 27 which is marginally shaped to fit snuggly into the socket 11 seen in FIG. 1. Since the foot heel contact surface of the cradle body 28 is a plane surface, as seen in FIGS. 8 and 9, it has been turned over to view in FIG. 5 to better show the formation of the ply 27 with finger projections 30. That cradle ply 27 is adhesively attached to carry a cushion body 28. The body 28 of the device 26 has a slightly concave configuration as indicated and in FIGS. 6 and 7 there is an extension 28A where the cradle ply 27 projects at 27A into the instep area 17. It is indicated in FIGS. 6 and 7 that the cradle ply 27 is curved from a crown surface 29 downwardly to its margins, and that crown surface is formed with a display of a set of finger projections 30 which are in substantial matching alignment with the fingers 18 formed in the area of socket 11 shown in FIG. 1, as well as the finger elements on the outsole 15. The cradle ply 27 is inserted in the socket 11 with its curved crown surface 29 exposed to view in the bottom of the socket, but spaced from the outsole pads 25. Thus, the display of cradle fingers 30 line up under the fingers 18 in the socket 11, and match the fingers in the opening of the outsole ply 15. Referring again to FIGS. 5 and 6, it is understood that the formation of spaced fingers 30 allows the body of the cushion to be formed with finger projections 31 which enter between fingers 30 so as to be exposed to view when the cradle device 26 is positioned in the socket 11. The cradle ply 27 has raised margins 31A which outline the spaces 31 between fingers 30 formed in the cushion 28.

Figure 10:
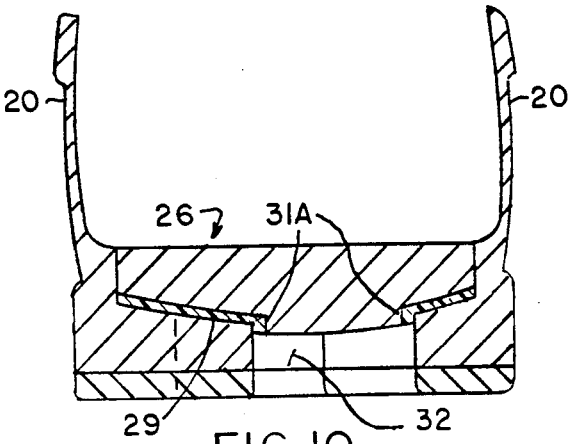
FIG. 10 is a transverse sectional view of the cushion centering device installed and taken along line 10—10 in FIG. 8.

The assembly or mounting of the device 26 is shown in FIGS. 8, 9 and 10, wherein FIG. 8 is a fragmentary longitudinal section of the midsole 10 extending to the instep area 17 from the heel wall 20. Since the socket 11 opens through the thickness of the midsole 10 there is an open space 32 beneath the device 26, and especially beneath the cradle 26. Thus the cushion 28 is presented in the upper surface of the midsole 10 and is substantially flush with that surface. An advantage in mounting the device 26 as indicated is that the curved crown 29 allows the cushion to react to the weight of the wearer to center the weight centrally so the foot is prevented from tilting. The view of FIGS. 9 and 10 illustrates the position of the device 26 with its element 29 curving upwardly along the opposite sides so the cushion can yield centrally when weight is applied.

The cradle device 26 consists of a ply 27 of a moldable plastic material with an elongated opening directed along the longitudinal axis of the shoe and a plurality of fingers project into that opening from opposite margins. The fingers are in staggered relation so that they alternate or are out of alignment so the space between fingers forms a sinuous path. That ply has been combined with a foamed cushioning means 28 to give it a desired hardness. The cushion body 28 or core may, if desired, consist of either silicon-polyurethane or a high rebound polyurethane. When formed with these materials the cradle device 26 provides a desired cushion effect, and the cushioning ply 27 is in contact with the fingers so that there is a desired stability for the fingers which function in the following manner.

The movement up or down of the cradle's "fingers" 18 is found in the normal heel area directly below the rear of the foot. When body weight is applied to the rear of the foot, each finger 18 will respond with just the right amount of "give" or resistance required for the weight load. As the foot moves forward through the walking or running gait cycle and weight is applied to the next "finger" 18 the previous "finger" snaps back into position providing a return or extra boost to the foot.

In addition to providing shock absorption and a "return" of energy the comfort cradle 26 also functions as a "self centering" device. By virtue of the opening beneath the device the rear or heel of a foot is actually suspended over the opening supported by the device's fingers 18. The fingers 18 then respond to provide the correct amount of resistance to keep the foot in a neutral position.

In summary the device provides three essential benefits:

1. Mechanical Cushioning/Shock Absorption
2. Stability via resistance from the fingers
3. Self centering suspension.

Additional shock absorption is provided by the cushioning core 27. This core 27 is molded to fit the concave shape of the ply 29 in the cradle device. By virtue of its material either silicone-polyurethane or High Rebound polyurethane, the shock is dispersed and by working in concert with the cradle device that shock energy is returned to the foot.

Therefore, having set forth the particular construction and function of the features of improvement, those novel features are believed to represent the nature of the subject invention.

What is claimed is:

1. In footwear having a foot supporting body construction comprising:

a) an assembly consisting of an outsole and a midsole together having longitudinally extending top and bottom surfaces forming a foot supporting structure, said surfaces defining a forepart, an instep portion, and a heel portion with an opening extending lengthwise of said longitudinal top and bottom surfaces and through said top and bottom surfaces of said instep and heel portions;

b) a plurality of spaced apart finger elements positioned in said heel portion extending inwardly to intersect said lengthwise opening in said heel portion and having free ends in said opening; and c) a foot heel supporting cradle device disposed in said opening, said cradle device presenting a bearing surface on said finger elements for support in said opening in said heel portion.

2. The construction set forth in claim 1 wherein said cradle device includes a ply of a yieldable cushion material combined with a substantially rigid ply on said yieldable cushion, said cushion material having a first surface substantially flush with said top surface of said midsole, and said substantially rigid ply being presented to said longitudinal opening in said outsole for exposure of said bearing surface in said opening.

3. The construction set forth in claim 2 wherein said substantially rigid ply is formed on its bearing surface with a plurality of finger elements substantially aligned with said spaced apart first mentioned finger elements on said body heel portion and having free ends, and said yieldable cushion material having a portion thereof bridging the spaces between said finger elements to be visible through said bottom surface of said heel portion.

4. The construction set forth in claim 2 wherein said rigid ply bearing surface is formed with an upwardly curved surface from a crown presented downwardly in said longitudinal opening in said outsole heel portion for substantially centering a force applied on said foot supporting first surface of said cushion means in said midsole top surface.

5. The construction set forth in claim 1 wherein said cradle device consists of a yieldable cushion material and a substantially rigid ply of material shaped to present an inner surface to carry said cushion material and an outer surface presented to bear upon said spaced apart finger elements.

6. In footwear having a foot supporting body construction comprising the improvement of:

a) a footwear midsole and an outsole portion joined together to afford support for a foot heel, said midsole and said outsole portions being formed to provide an opening through both said midsole and outsole portions;

b) a plurality of finger elements located to extend inwardly into positions intercepting said opening and said finger elements being separated and having free ends so as to be capable of independent movement in said opening; and c) foot heel cradling device received in said opening to assume a position in said opening for support on said finger elements, said cradling device being responsive upon receiving a foot heel for exerting a force on said finger elements to cause movement of said finger elements in said opening.

7. In footwear having a midsole and an outsole united to provide a foot supporting longitudinal surface for the heel and instep portions of a foot, a longitudinal opening formed to open through the united midsole and outsole in the heel and instep portions, and a plurality of spaced apart finger elements positioned to extend into the heel portion of the longitudinal opening, the improvement comprising:

a) a foot heel supporting cushion body presenting a cradling surface to the heel of a foot; said cushion fitting into the longitudinal opening in the heel and instep portions; and b) a substantially rigid ply of material engaged by said cushion to provide support for said cushion, said rigid ply being exposed to view in the longitudinal opening of the heel and instep and resting on the plurality of spaced apart fingers extending into the longitudinal opening.

8. The improvement set forth in claim 7 wherein said substantially rigid ply of material being formed with apertures which are aligned with the spaces between the finger elements, and said cushion body having portions thereof exposed to view in the longitudinal opening through the apertures in said rigid ply of material.

* * * * *